United States Patent [19]

Frank

[11] 3,974,750

[45] Aug. 17, 1976

[54] METHOD AND APPARATUS FOR NEUTRALIZING ELECTROSTATIC CHARGES OF FILTER MATERIAL FOR SMOKERS' PRODUCTS

[75] Inventor: Willi Frank, Wentorf, Germany

[73] Assignee: Hauni-Werke Körber & Co., KG, Hamburg, Germany

[22] Filed: Feb. 6, 1975

[21] Appl. No.: 547,885

[30] Foreign Application Priority Data

Mar. 16, 1974 Germany ..... 2412776

[52] U.S. Cl. ..... 93/77 FT; 204/165; 204/168

[51] Int. Cl.[2] ..... B01K 1/00; A24C 5/50

[58] Field of Search ..... 93/1 C, 77 FT; 131/262 R, 262 A; 204/165, 168

[56] References Cited

UNITED STATES PATENTS

| | | | |
|---|---|---|---|
| 3,106,501 | 10/1963 | Cobb, Jr. et al. | 93/1 C |
| 3,527,234 | 9/1970 | Hinzmann | 93/77 FT |
| 3,723,289 | 3/1973 | Boom | 204/168 X |
| 3,769,883 | 11/1973 | Greve | 93/77 FT X |
| 3,817,701 | 6/1974 | Thorsen | 204/165 X |

*Primary Examiner*—James F. Coan

*Attorney, Agent, or Firm*—Peter K. Kontler; John Kurucz

[57] ABSTRACT

Successive filter rod sections which are produced in a filter rod making machine are caused to pass through a body of ionized air before they leave the machine. This insures that ionized air destroys the electrostatic charges which the non-conductive wrappers and/or fillers of filter rod sections accumulate in the machine upstream of the ionizing station. The conveyor or conveyors which transport the filter rod sections through ionized air are designed to transport the sections sideways. At least one electrode of the ionizing device or devices for air is preferably connected with a source of high-voltage a-c energy.

11 Claims, 2 Drawing Figures

METHOD AND APPARATUS FOR NEUTRALIZING ELECTROSTATIC CHARGES OF FILTER MATERIAL FOR SMOKERS' PRODUCTS

BACKGROUND OF THE INVENTION

The present invention relates to a method and apparatus for treating filter material which is utilized in smokers' products, especially for treating continuous filter rods and/or sections of filter rods which can be utilized in the manufacture of filter cigarettes, cigars or cigarillos. More particularly, the invention relates to treatment of rod-like filters wherein a tubular wrapper of non-conductive material surrounds one or more rod-like fillers consisting of non-conductive material. For example, the wrapper may consist of paper or imitation cork and the filler may consist of paper or acetate fibers. The term "non-conductive" is intended to denote dielectrics as well as materials which are poor conductors of electricity, i.e., materials which tend to retain electrostatic charges.

Filter rods which are used in the mass-production of filter cigarettes or analogous rod-shaped smokers' products are normally produced in machines wherein a tow of fibrous filter material is conditioned with a plasticizer and is thereupon wrapped into a web of paper or the like. The thus obtained rod is severed at regular intervals to yield a succession of filter rod sections of desired length which are transported to storage or directly or indirectly to one or more consuming machines. The components of the filter rod, the filter rod and its sections are in continuous motion; as a rule, the movement is interrupted only when the filter rod sections enter a charger or tray, the magazine of a machine which assembles filter rod sections with plain cigarettes or the like, or the magazine of a pneumatic sender which propels filter rod sections into the magazines of discrete machines for the making of filter tipped smokers' products.

When the material of the filler moves relative to its conveying means, when the material of the wrapper moves relative to its conveying means and/or relative to the material of the filler, when the filaments of the filler move relative to each other, when the filter rod moves relative to its supporting and/or advancing means, and/or when the filter rod sections move relative to their supporting and advancing means, such materials accumulate substantial electrostatic charges. These charges are often highly undesirable because they prevent reproducible transport of successive filter rod sections by opposing the movement of sections along a predetermined path or by causing the sections to move along a path other than the desired path. For example, electrostatic charging of filter rod sections could cause undesirable shifting of sections in the interior of a charger or tray which consists of a synthetic plastic material. The elimination of such charges is not possible by simple grounding of the machine or those machine components which contact the filter material.

SUMMARY OF THE INVENTION

An object of the invention is to provide a novel and improved method of treating filter material, especially filter material which takes the form of a continuous rod or sections of a rod wherein a tubular wrapper of non-conductive material surrounds one or more rod-like fillers of non-conductive material.

Another object of the invention is to provide a method of relieving filter rod sections of electrostatic charges before the charges can adversely influence the transport or other manipulation of sections.

A further object of the invention is to provide a method of preventing static electricity from adversely influencing the making, transport and/or other manipulation of filter material of the type wherein a tubular wrapper surrounds a rod like filler and wherein the materials of the wrapper and filler are poor conductors of electricity.

An additional object of the invention is to provide a machine for the making of filter rod sections with novel and improved means for preventing static electricity from adversely influencing the operation of such machine and/or further processing of filter rod sections.

A further object of the invention is to provide a filter rod making machine with novel and improved means for treating filter rods and/or filter rod sections in such a way that the treatment does not result in a reduction of but rather enhances the output of the machine and allows for simpler and more accurately reproducible manipulation of filter rods and their sections in the machine proper as well as after the sections leave the machine.

One feature of the invention resides in the provision of a method of treating filter material for smokers' products, particularly a rod wherein a tubular wrapper of paper or other non-conductive material surrounds a filler consisting of acetate fibers, paper or other non-conductive material. The method comprises the steps of conveying the filter material along a predetermined path, and contacting the filter material with an ionized gas (e.g., air) in at least one predetermined portion of the path. This insures that, if an electrostatic charge has been applied to filter material upstream of the one predetermined portion of the path, such charge is neutralized before the filter material leaves its path.

The method preferably further comprises the step of subdividing a continuous filter rod (which constitutes the filter material) into a succession of discrete filter rod sections each having a predetermined length. The conveying step then comprises moving successive sections of the filter rod along the one predetermined portion of the path. The sections are preferably moved sideways so that each and every portion thereof remains in the one predetermined portion of the path longer than if the sections were to advance lengthwise.

The novel features which are considered as characteristic of the invention are set forth in particular in the appended claims. The improved machine itself, however, both as to its construction and its mode of operation, together with additional features and advantages thereof, will be understood upon perusal of the following detailed description of certain specific embodiments with reference to the accompanying drawing.

DESCRIPTION OF THE PREFERRED EMBODIMENTS

Figures 1, 2:
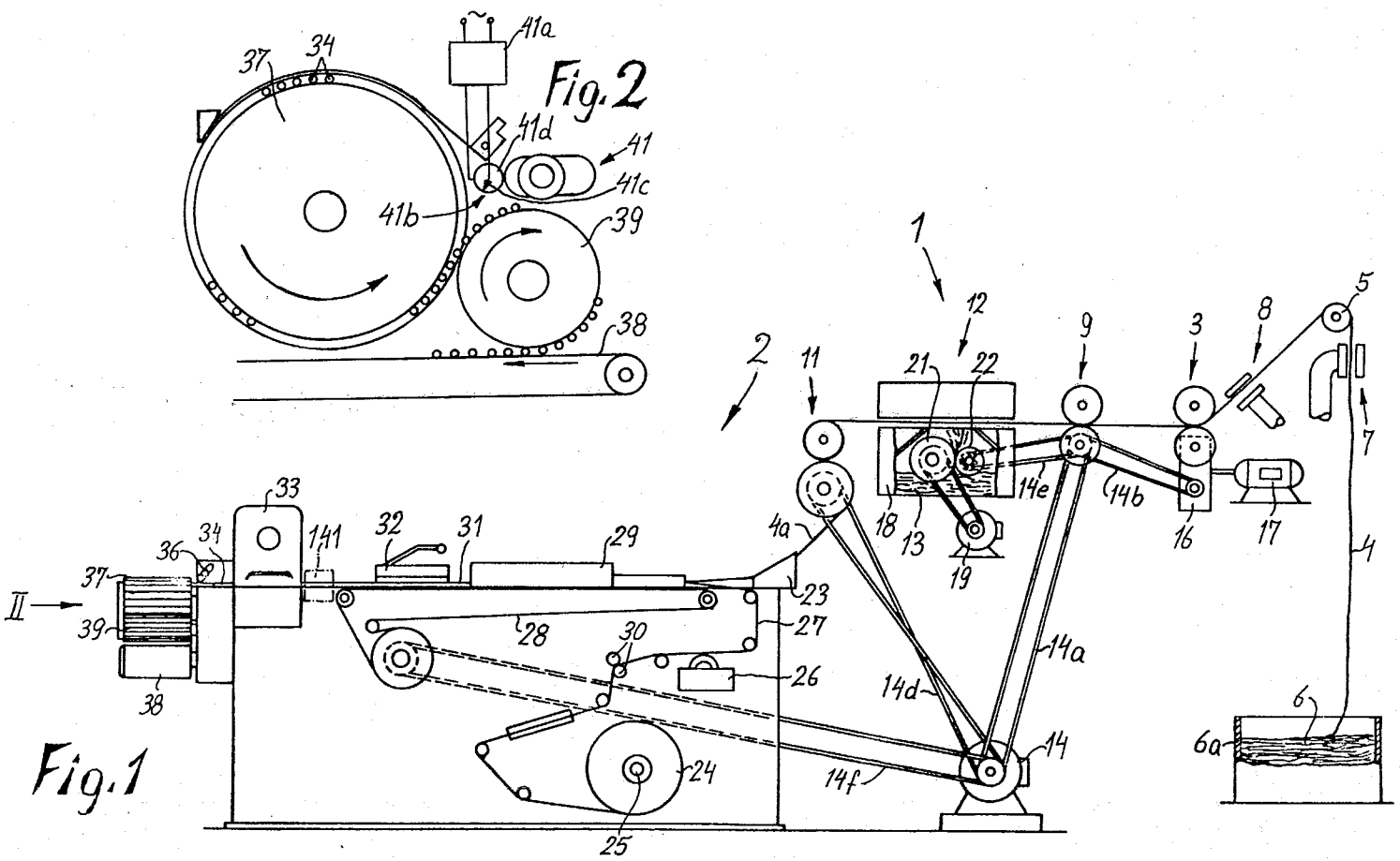
FIG. 1 is a diagrammatic partly side elevational and partly sectional view of a filter rod making machine which embodies the invention.
FIG. 2 is an enlarged end elevational view substantially as seen in the direction of arrow II in FIG. 1.

FIG. 1 shows a filter rod making machine of the type known as KDF produced by Hauni-Werke Körber &

Co. KG, of Hamburg, Germany. The machine comprises two main units, namely a first unit 1 which conditions a continuous tow 4 of fibrous filter material (e.g., acetate fibers) and a second unit 2 which assembles the conditioned tow 4*a* with a continuous web of wrapping material 27 to form a continuous filter rod 31 which is thereupon subdivided into a succession of filter rod sections 34 of desired length.

The first unit 1 comprises a receptacle 6*a* constituting a source of supply of fibrous filter material and containing a bale 6 consisting of a substantial length of untreated tow 4 having crimped filaments. The means for continuously withdrawing the tow 4 from the receptacle 6*a* comprises a pair of driven advancing rolls 3 which cause successive increments of the tow to pass through a first conventional banding device 7, thereupon around a guide roller 5, and through a second banding device 8. Each banding device comprises means for separating and loosening the filaments of the tow 4 with streamlets of compressed air. The advancing rolls 3 are followed by two additional pairs of advancing rolls 9 and 11. Those portions of the tow 4 which advance between the rolls 9 and 11 pass through an impregnating or conditioning device 12 wherein the filaments of the tow are contacted by particles of an atomized plasticizer 13 (such as triacetin) which partially melts or softens the filaments so that they adhere to each other during travel through the second unit 2. The tow which advances across the space between the rolls 9 and 11 is in the form of a flat layer wherein the filaments are substantially or exactly parallel to each other to thus insure uniform distribution of atomized plasticizer 13 therein. One roll of each pair of rolls 9 and 11 is preferably formed with a grooved or channeled peripheral surface and the other roll of each pair of rolls 9 and 11 is preferably formed with a smooth surface provided on a layer of elastomeric material. The lower roll 3 is driven by the output element of a variable-speed transmission 16 whose input element is driven by an endless belt or chain 14*b*. The latter is driven by the lower roll 9 which receives torque from an endless belt or chain 14*a* receiving motion from a main prime mover 14, e.g., an electric motor. The ratio of the transmission 16, and hence the speed of the rolls 3, can be regulated by a reversible electric motor 17 which can be started and arrested by a control unit, e.g., in response to signals which are produced by a device for monitoring the density of the tow downstream of the rolls 11 and/or the resistance which the filter rod sections 34 offer to axial flow of a gaseous testing fluid. The rolls 3 then cooperate with the rolls 9 to produce a more or less pronounced stretching action upon the filaments of the tow and to thus change the quantity of filter material per unit length of the filter rod 31. As a rule, the peripheral speed of the rolls 3 is less than the peripheral speed of the rolls 9 so that the filaments of the tow 4 are subjected to at least some stretching action or are stretched all the way to the elastic limit in a manner as disclosed in the commonly owned copending application Ser. No. 4,018 of Block.

The lower roll 11 is driven by a further endless belt or chain 14*d* which receives motion from the output element of the main prime mover 14.

The conditioning device 12 comprises a vessel or tank 18 for a supply of liquid plasticizer 13, a withdrawing roller 21 which dips into the supply of plasticizer in the vessel 18 so that its peripheral surface removes a thin film of plasticizer, a constant- or variable-speed electric motor 19 which drives the roller 21, and a rotary cylindrical brush 22 whose bristles convert the thin film of plasticizer into minute liquid particles and propel the particles against the filaments of the tow 4 between the rolls 9 and 11. The brush 22 is driven by an endless belt or chain 14*e* which receives motion from the lower roll 9. The thus conditioned tow 4*a* advances between the rolls 11 and enters a gathering horn 23 which converts it into a rod-like filler ready to be wrapped into a web of cigarette paper, imitation cork or other suitable wrapping material 27.

The horn 23 forms part of the second unit 2 which further comprises a shaft 25 supporting a bobbin or roll 24 of convoluted wrapping material 27, advancing rolls 30 which draw the material 27 (hereinafter called web) off the roll 24, a paster 26 which coats one marginal portion or the entire underside of the web 27 with a suitable adhesive (e.g., a hotmelt) and a wrapping mechanism which converts the web 27 and the rod-like filler (conditioned tow 4*a*) into a continuous filter rod 31. The wrapping mechanism comprises an endless conveying belt 28 (known as garniture) having an upper stretch which entrains the web 27 downstream of the paster 26 and also advances the filler through a draping device 29 wherein the web is folded around the filler so that its adhesive-coated marginal portion overlaps the other marginal portion and forms therewith a seam of the resulting tubular wrapper of the rod 31. The seam is thereupon heated and/or cooled at 32 (depending on the nature of adhesive which has been applied by the paster 26) so that it can withstand the tendency of the confined (and compacted) filler to expand radially. The garniture 28 is driven by the main prime mover 14 through the medium of a chain or belt 14*f*. The prime mover 14 can also drive the rolls 30.

The filter rod 31 is thereupon severed at regular intervals by a cut-off mechanism 33 to yield a succession of filter rod sections 34 which are accelerated by one or more lobes of a rapidly rotating cam 36 and are propelled into successive flutes of a drum-shaped conveyor 37 serving to transport the filter sections 34 sideways (see FIG. 2). For example, the cut-off mechanism 33 can subdivide the rod 31 into sections 34 of six times unit length. The flutes of the conveyor 37 are preferably formed with suction ports which attract the sections 34 during transport toward a transfer station between the conveyor 37 and a drum-shaped intermediate conveyor 39. The latter preferably attracts the sections 34 by suction during transport onto the upper stretch of a conveyor belt 38. The belt 38 can transport sections 34 to an apparatus which introduces the sections into suitable chargers or trays (for example, in a manner as disclosed in the commonly owned German Pat. No. 1,192,964) and/or to a pneumatic sender which propels filter rod sections into the magazines of two or more machines for the making of filter cigarettes, cigars or cigarillos. A suitable sender is disclosed, for example, in the commonly owned German Offenlegungsschrift No. 2,025,657.

The rod 31 and/or filter rod sections 34 accumulate electrostatic charges during travel in the unit 2 and/or during introduction into the flutes of the conveyor 37. The extent to which the parts 31, 34 are electrostatically charged depends on the nature of their material, on the nature of the material of components along and/or with which such parts move, and on the relative speed of parts. Electrostatic charging of the rod 31 and/or its sections 34 is highly undesirable because it interferes with desired movements and/or causes undesirable movements of sections 34. As a rule, the material of the tubular wrapper (normally paper) and filler (acetate fibers, paper or the like) is a poor conductor of electricity, i.e., it can be considered a non-conductor or dielectric. Therefore, the accumulated electrostatic charge cannot be led away by simple grounding of the wrappers due to the fact that a charge placed on a non-conductor remains where it was placed. Thus, grounding of the wrappers of sections 34 and/or the wrapper of rod 31 would merely relieve from electrostatic charge that portion or those portions of the wrapper(s) which are actually grounded; however, the remaining portion of the wrapper as well as the entire filler would invariably retain its charge.

FIG. 2 shows an ionizing device 41 which is adjacent to that portion of the path of filter rod sections 34 wherein the sections move sideways with the intermediate conveyor 39, preferably close to the transfer station where the sections 34 leave the flutes of the conveyor 37. The ionizing device 41 is preferably connected with a source of a-c energy (e.g., a transformer 41*a*), i.e., at least one of its electrodes 41*b* is connected with a generator of a-c current. This insures that the device will destroy the electrostatic charges of successive sections 34 irrespective of the sign or polarity of such charges. The sign of the electrostatic charge depends on the nature of material of the filter rod. A suitable ionizing device which can be used in the machine of FIG. 1 is manufactured by CEAG DOMINIT, 477 Soest, West Germany, and is known as Type EGHK 1 (e.g., catalog item No. 491 0050) with electrodes 41*b* of the type wherein equally spaced needles 41*c* of metallic material are installed in a tube 41*d* consisting of synthetic plastic material. The needles 41*c* are connected to each other and to the transformer 41*a* or another suitable source of high-voltage energy.

It is clear that the machine of FIG. 1 can also employ a d-c ionizing device when the manufacturer of filter rod sections knows that the electrostatic charge which the rod 31 and/or sections 34 accumulate has a certain polarity. As a rule, the ionizing device will be designed with a view to insure ample ionization of air in the selected region, i.e., it is preferred to employ high ionization voltages (e.g., in the range of 5–6 thousand volts). In order to reduce the likelihood of danger to attendants, the ionizing device preferably includes suitable current limiting means which reduces the amperage of the current (e.g., to 1mA).

The placing of the ionization device 41 at the locus shown in FIG. 2 is particularly advantageous because the filter rod sections 34 move sideways during transport through the region containing ionized air. Therefore, the length of intervals during which successive sections 34 remain in the ionized atmosphere is much longer than if the sections were transported lengthwise. Such mode of transporting filter rod sections 34 through the ionized atmosphere has been found to insure that the sections are relieved of electrostatic charges or that such charges are reduced to a permissible value. The forward speed of sections 34 decreases very substantially on the conveyors 37, 39 38, i.e., such speed is much less than the speed of sections in the region of the accelerating cam 36. The sections which are being advanced past and beyond the ionization device 41 do not perform any pronounced movements with respect to the conveyors 37, 38 and 39 so that they are not likely to be recharged before they reach a tray or the aforementioned sender.

It is also within the purview of the invention to utilize the ionization device 41 with or to replace this device by an ionization device which is adjacent to the path of movement of the filter rod 31. Such second ionization device is indicated in FIG. 1 by phantom lines, as at 141, and is placed immediately upstream of the cutoff mechanism 33. Still further, the ionization device 41 can be placed adjacent to the conveyor belt 38, or the machine may be equipped with more than two ionization devices including the one shown at 41, the one shown at 141 and at least one additional device (e.g., adjacent to the upper stretch of the belt 38). It has been found that, as a rule, the placing of a single ionization device adjacent to that portion of the path wherein the filter rod 31 travels sideways (i.e., wherein the sections or portions 34 of the rod 31 travel sideways downstream of the cut-off mechanism 33) suffices to insure that the sections are relieved of their charges to the extent which is needed to guarantee a predictable transport and/or other manipulation of sections after they leave the machine. The length of intervals during which successive nonseparated sections 34 travel through the ionized atmosphere produced by the device 141 is only a small fraction of the length of intervals during which a section 34 remains in the atmosphere created by the device 41.

An important advantage of the improved method and machine is that the sections which leave the machine are substantially or entirely free of electrostatic charges. At any rate, the electrostatic charges are removed to the extent which is needed to insure that the sections can be moved in a predictable and reproducible manner, i.e., that they can perform all desired movements and that they do not perform any undesired movements on their way from the filter rod making machine to storage, to a sender or directly into the magazine or magazines of one or more machines for the making of filter cigarettes, cigars or cigarillos. The feature that the filter rod and/or its sections are caused to pass through a body of ionized gas insures that the electrostatic charge is removed not only from the wrapper but also from the filler of the rod and/or each filler rod section. The transport of the filter rod and/or its sections through a body of ionized gas does not affect the appearance and/or quality of filter material. On the contrary, the filter rod sections are much less likely to be deformed during transport from the maker because they are free of electrostatic charges and, therefore, each thereof can be manipulated in a reproducible manner, i.e., in exactly the same way as each preceding section.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by letters Patent is:

1. A method of treating electrically nonconductive filter material for smokers' products, particularly a rod wherein a tubular wrapper surrounds a filler, which is electrostatically charged as a result of the making and- /or manipulation thereof, comprising the steps of conveying the filter material along a predetermined path; and contacting the filter material with an ionized gas in at least one predetermined portion of said path whereby the gas neutralizes the electrostatic charge of the filter material.

2. A method as defined in claim 1, wherein said gas is air.

3. A method of treating a filter rod as defined in claim 1, further comprising the steps of subdividing the rod into a succession of discrete sections upstream of said one predetermined portion of said path, said conveying step comprising advancing successive sections along said one predetermined portion of said path.

4. A method as defined in claim 3, wherein said sections move sideways during travel along said one predetermined portion of said path.

5. In a machine for the making and treatment of electrically non-conductive filter material for smokers' products which is electrostatically charged as a result of the making and/or manipulation thereof, a combination comprising a unit for assembling a rod-like filler with a tubular wrapper into a filter rod which constitutes said filter material; means for conveying said rod along a predetermined path; and a device for contacting the rod with an ionized gas in at least one portion of said path whereby the gas neutralizes the electrostatic charge of the rod.

6. A combination as defined in claim 5, further comprising means for subdividing said rod into a succession of discrete sections upstream of said one predetermined portion of said path.

7. A combination as defined in claim 6, wherein said device comprises air ionizing means.

8. A combination as defined in claim 6, wherein said device comprises a plurality of electrodes and means for applying a-c energy to at least one of said electrodes.

9. A combination as defined in claim 8, wherein said energy applying means comprises a source of high-voltage a-c energy.

10. A combination as defined in claim 6, wherein said conveying means comprises means for moving successive sections sideways along said one predetermined portion of said path.

11. A combination as defined in claim 10, wherein said means for moving successive sections sideways comprises a plurality of successive conveyors and said device is adjacent to one of said conveyors.

* * * * *

UNITED STATES PATENT OFFICE

CERTIFICATE OF CORRECTION

Patent No. 3,974,750 Dated August 17, 1976

Inventor(s) Willi FRANK

It is certified that error appears in the above-identified patent and that said Letters Patent are hereby corrected as shown below:

Col. 2, line 54, the word --best-- should be inserted after "be".

Col. 5, line 63, a comma should be inserted after "39".

Col. 6, line 44, "filler" (second occurrence) should read --filter--;

line 64, "letters" should read --Letters--.

Claim 7, line 1, "6" should read --5--.

Claim 8, line 1, "6" should read --5--.

Signed and Sealed this

Second Day of November 1976

[SEAL]

*Attest:*

RUTH C. MASON
*Attesting Officer*

C. MARSHALL DANN
*Commissioner of Patents and Trademarks*